US006851521B2

(12) United States Patent
Studhalter

(10) Patent No.: US 6,851,521 B2
(45) Date of Patent: Feb. 8, 2005

(54) EMERGENCY UNLOCKING DEVICE AT SHAFT DOORS OF ELEVATORS

(75) Inventor: Ernst Studhalter, Lucerne (CH)

(73) Assignee: Inventio AG, Hergiswil (CH)

( * ) Notice: Subject to any disclaimer, the term of this patent is extended or adjusted under 35 U.S.C. 154(b) by 238 days.

(21) Appl. No.: 10/325,361

(22) Filed: Dec. 19, 2002

(65) Prior Publication Data

US 2003/0116383 A1 Jun. 26, 2003

(30) Foreign Application Priority Data

Dec. 20, 2001 (EP) ..... 01811248

(51) Int. Cl.[7] ..... B66B 13/16
(52) U.S. Cl. ..... 187/314; 187/335; 187/308
(58) Field of Search ..... 187/308, 309, 187/310, 314, 335

(56) References Cited

U.S. PATENT DOCUMENTS 2,067,242 A * 1/1937 Norton ..... 187/314
4,252,218 A * 2/1981 Cowardin ..... 187/314
4,483,420 A * 11/1984 Byrne ..... 187/331

FOREIGN PATENT DOCUMENTS

| | | | | |
|---|---|---|---|---|
| EP | 506155 A2 * | 9/1992 | ..... | B66B/13/16 |
| EP | 0838 425 | 4/1998 | | |
| JP | 61238688 | 10/1986 | | |
| JP | 02158592 | 6/1990 | | |
| JP | 08067475 A * | 3/1996 | ..... | B66B/13/16 |
| WO | WO 9532911 A1 * | 12/1995 | ..... | B66B/13/24 |

* cited by examiner

*Primary Examiner*—Eileen D. Lillis
*Assistant Examiner*—Thuy V. Tran
(74) *Attorney, Agent, or Firm*—MacMillan, Sobanski & Todd, LLC

(57) ABSTRACT

An emergency unlocking device includes an unlocking lever actuated by an unlocking slide that is guided in a guide fastened to the inner side of the shaft door. The guide covers a passage that is formed in the shaft door for insertion of a tool for actuation of the unlocking slide so that in the case of a fire the flame cannot pass through the passage to the elevator shaft.

12 Claims, 2 Drawing Sheets

EMERGENCY UNLOCKING DEVICE AT SHAFT DOORS OF ELEVATORS

BACKGROUND OF THE INVENTION

The present invention relates to an emergency unlocking device at shaft doors of elevators, wherein a rotatably mounted locking lever movable with the shaft door and acting on an emergency actuating element is provided.

The shaft doors of the elevator are, in the locked state, locked with the door frame, wherein usually a locking lever rotatably mounted at the shaft door is in engagement with a locking element fastened to the door frame. In order to gain access to the elevator shaft in the case of breakdowns or in other emergency cases it must be possible for an authorized person to open a locked shaft door from the floor, for which purpose emergency unlocking devices are provided.

A device for emergency unlocking of elevator doors is shown in the European Patent Application EP-A-838425, in which a hook lock rotatably mounted at a carrier plate connected with the suspension carriage of the shaft door is provided. The hook lock is formed as a double lever, wherein one lever arm has a hook and the other lever arm is provided with a weight so that the hook is always biased upwardly. The hook in that case engages in a recess of a fixedly mounted anchoring element so that a lateral displacement of the suspension carriage or the shaft door is not possible. A release web with a bent-over portion, which is pushed under a release rod on closing of the shaft door, is fastened to the hook lock. The release rod is fastened to a rotatably arranged rotary lever that is held in the locked setting by means of a tension spring. A Bowden pull is connected by one end with the rotary lever, wherein the other end of the Bowden pull is fastened to a pull lever of an actuating element. The actuating element is arranged at the underside of a visible door frame member and is accessible from the floor of the building.

SUMMARY OF THE INVENTION

The present invention has the object of proposing an emergency unlocking device which is simpler relative to the prior art device described above and which can, in addition, fulfill the relevant regulations for safety in the case of a fire.

The device according to the present invention has a locking lever actuated by an unlocking slide guided in a guide fastened to the inner side of the shaft door. The guide covers a passage which is formed in the shaft door and through which a tool for actuation of the unlocking slide can be inserted.

The advantages achieved by the device according to the present invention are that the unlocking slide consists of only one piece, whereas in the prior art several parts are required for the connection between the hook lock and the actuating element. By virtue of the guide being provided at the same time as a receiver for the unlocking slide and as a cover of the passage in the shaft door, flame is prevented from passing over to the elevator shaft in the case of fire. A more economic, more fireproof and space-saving solution can therefore be realized by the proposed device.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
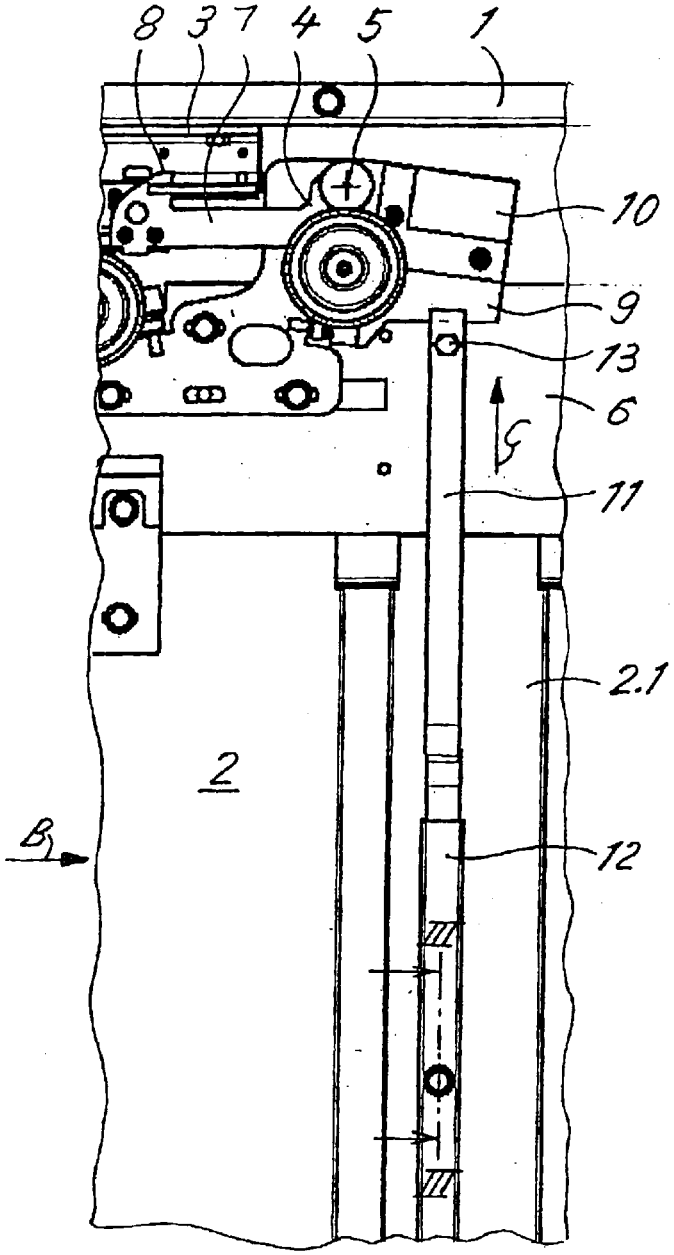
FIG. 1 is a fragmentary schematic view of an emergency unlocking device in accordance with the present invention taken in the direction of an arrow A in FIG. 2.
Figure 2:
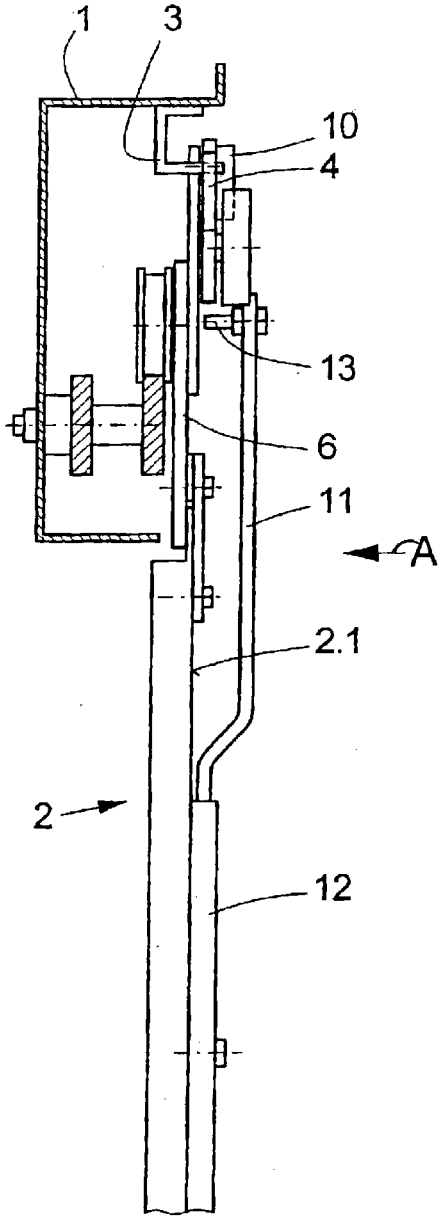
FIG. 2 is a fragmentary schematic view in partial cross section of the emergency unlocking device taken in the direction an arrow B in FIG. 1.

A transom 1 is connected with a door frame of an elevator shaft door 2 and has a locking element 3 fastened thereto as shown in FIGS. 1 and 2. A locking lever 4 is mounted at a suspension carriage 6 of the shaft door 2 to be rotatable about an axis 5. The locking lever 4, which is in the form of a double lever, has a hook 8 formed at a free end of one lever arm 7, while a weight 10 is fastened to another lever arm 9. In the locked state (as illustrated in FIG. 1) the one lever arm 7 is raised under the influence of the weight 10 and the hook 8 is in engagement with the locking element 3. Thus, movement of the elevator door 2 is prevented.

Arranged below the lower lever arm 9 is an emergency actuating element, which element includes a rod-shaped unlocking slide 11 with a rectangular cross-section and a bolt 13. The unlocking slide 11 is slidably guided in a guide 12 in the form of a square tube that is fixedly connected with an inner side 2.1 of the shaft door 2. The bolt 13, by means of which the lever arm 9 of the locking lever 4 is raised and the shaft door 2 unlocked on actuation of the unlocking slide 11 in the direction of an arrow C (FIG. 1), is provided at the upper end of the unlocking slide 11.

Figure 3:
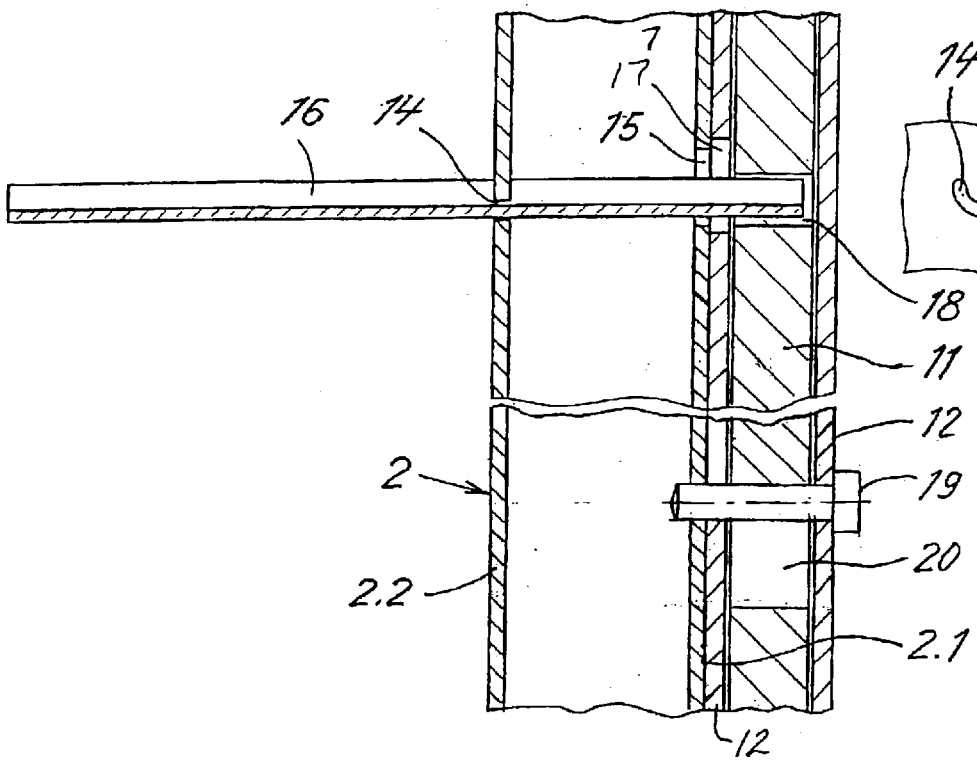
FIG. 3 is an enlarged cross-sectional view taken along the line III—III in FIG. 1 with an unlocking tool in a first setting.
Figure 5:
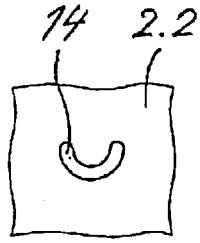
FIG. 5 is a fragmentary elevation view of the entry opening of a passage in a shaft door shown in FIGS. 3 and 4.
Figure 4:
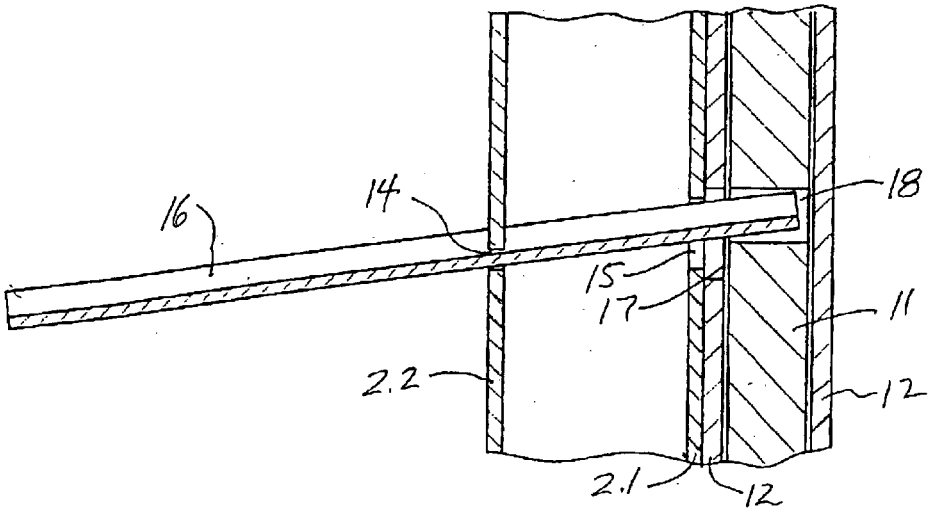
FIG. 4 shows an upper portion of FIG. 3 with the unlocking tool in a second setting.

As shown in FIGS. 3 to 5, a passage having an entry opening 14 and an exit opening 15 is provided in the shaft door 2. The entry opening 14 is formed in an outer side 2.2 of the shaft door 2 and is matched to the shape of a tool 16 to be inserted for the unlocking. For example, the entry opening 14 can be a semicircular slot, as shown in FIG. 5, while the tool 16 has a corresponding profile. The exit opening 15 at the inner side 2.1 of the shaft door 2, as well as a further passage 17 in the guide 12 are formed in such a manner that the tool 16 can move unhindered in the unlocking process as shown in FIG. 4. An end of the tool 16 engages in an opening 18 formed through the unlocking slide 11. The guide 12 is fastened by means of screws 19 to the inner side 2.1 of the shaft door 2, wherein the passage in the shaft door is covered and flame is prevented from passing over to the elevator shaft in the case of fire. The screws 19 protrude through slots 20 of the unlocking slide 11, wherein in the locking setting (FIG. 1) the slide bears on a screw 19 at an upper edge of one of the slots 20.

It is also possible to form the entry opening 14 as a T-shaped, U-shaped or any other suitable form of slot. Since correspondingly formed tools are required for an emergency unlocking of the shaft door, an unlocking by unauthorized persons is thereby be made difficult.

Instead of the square tube there can also be used for the guide 12 a hat-section profile member connected with the inner side 2.1 of the shaft door 2 by, for example, spotwelding. A hat-section profile member is produced, for example, by bending or drawing metal into a U-shaped cross-section with webs or flanges extending outwardly at right angles at the upper ends of the legs.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An emergency unlocking device for a shaft door of an elevator, the shaft door having a locking lever rotatably mounted thereon and movable with the shaft door, the locking lever acting on an emergency actuating element, comprising:

a guide fixedly connected with an inner side of a shaft door and guiding an emergency actuating element to be linearly displaceable;

a passage formed through the shaft door and aligned with a passage formed in said guide and with an opening formed in the emergency actuating element; and a tool having an end insertable through said passages and into said opening for displacing the emergency actuating element from a shaft door locked position to a shaft door unlocked position.

2. The emergency unlocking device according to claim 1 wherein said passage through the shaft door is closed adjacent the inner side of the shaft door by said guide in a fireproof manner.

3. The emergency unlocking device according to claim 1 wherein said guide is formed with one of a square tube profile and a hat-section profile.

4. The emergency unlocking device according to claim 1 wherein said passage has a predetermined shape entry opening formed in an outer side of the shaft door that said tool has a profile of said predetermined shape.

5. The emergency unlocking device according to claim 4 wherein said entry opening is a semicircular slot.

6. An emergency unlocking device for a shaft door of an elevator comprising:

a guide fixedly connected with an inner side of an elevator shaft door;

an emergency actuating element guided by said guide for movement relative to the door and having a first passage formed therein;

a second passage formed through the shaft door between an outer side of the shaft door and the inner side, said second passage being aligned with said first passage and with an opening formed in said emergency actuating element; and a tool having an end insertable through said first and second passages and into said opening for displacing said emergency actuating element from a shaft door locked position to a shaft door unlocked position.

7. The emergency unlocking device according to claim 6 wherein said emergency actuating element includes a rod-shaped unlocking slide having a rectangular cross-section profile.

8. The emergency unlocking device according to claim 6 wherein said emergency actuating element includes a rod-shaped unlocking slide having at least one slot formed therein through which a screw extends fastening said guide to the inner side of the shaft door, whereby when said unlocking slide is in a locked position an upper edge of said at least one slot bears on said screw.

9. The emergency unlocking device according to claim 6 wherein said first and second passages are closed adjacent the inner side of the shaft door by said guide in a fireproof manner.

10. The emergency unlocking device according to claim 6 wherein said guide is formed with one of a square tube profile and a hat-section profile.

11. The emergency unlocking device according to claim 6 wherein said second passage has a predetermined shape entry opening formed in the outer side of the shaft door that said tool has a profile of said predetermined shape.

12. The emergency unlocking device according to claim 11 wherein said entry opening is a semicircular slot.

* * * * *